US005203493A

United States Patent [19]

Moody

[11] Patent Number: 5,203,493

[45] Date of Patent: Apr. 20, 1993

[54] CONVERTIBLE TACO PACKAGE AND HOLDER

[76] Inventor: Donald C. Moody, 2138 E. Pierce, Phoenix, Ariz. 85006

[21] Appl. No.: 863,769

[22] Filed: Apr. 6, 1992

[51] Int. Cl.[5] ..... B65D 5/06

[52] U.S. Cl. ..... 229/103; 229/242; 229/904; 229/DIG. 13; 206/216; 426/115

[58] Field of Search ..... 229/103, 904, DIG. 13, 229/221, 240, 242, 243, 244; 206/45.12, 45.14, 216; 426/112, 115, 124, 128

[56] References Cited

U.S. PATENT DOCUMENTS

| | | | |
|---|---|---|---|
| 1,194,172 | 8/1916 | Harbeck | 229/242 |
| 3,157,344 | 11/1964 | Hennessey | 229/244 |
| 3,324,998 | 6/1967 | Farquhar | 229/904 |
| 3,637,130 | 1/1972 | Farquhar | 229/103 |
| 4,099,665 | 7/1978 | Bergstein | 229/221 |
| 4,469,271 | 9/1984 | Kulig | 229/904 |
| 4,573,570 | 3/1986 | Cortopassi | 229/DIG. 13 |
| 4,573,579 | 3/1986 | Murdick et al. | 229/DIG. 13 |
| 4,705,173 | 11/1987 | Forbes, Jr. | 229/904 |
| 4,746,010 | 5/1988 | Fournier | 229/103 |
| 4,896,820 | 1/1990 | Harrington | 229/117.03 |

*Primary Examiner*—Allan N. Shoap
*Assistant Examiner*—Christopher McDonald
*Attorney, Agent, or Firm*—Don J. Flickinger; Jordan M. Meschkow; Lowell W. Gresham

[57] ABSTRACT

A convertible taco package having a bottom portion receivable within a top portion, and having parallel and medial perforations defining strips which are detachable. Slots are formed from the detachment of the strips, into which taco shells may be inserted. The detached strips are separated to form tabs which support the taco shells in the slots.

7 Claims, 2 Drawing Sheets

TACO
SHELLS

CONVERTIBLE TACO PACKAGE AND HOLDER

BACKGROUND OF THE INVENTION

1. Field of the Invention

This invention relates to packaging for food products.

More particularly, the present invention relates to packaging for food products which are convertible to a cooking devices.

More specifically, the present invention relates to packaging for tacos which are convertible to taco preparing devices.

2. Prior Art

Since the decline of selling food products in bulk, packaging has become very important to the food product industry. Packages for food products come in a wide variety of shapes and sizes, but all are intended to package a food product in a unit of a size acceptable to the consumer. These packages provide a convenient and sanitary means for distributing food products to the public. Newer and more convenient packages are continually being developed, using less expensive materials, providing easy opening packages, and providing attention-getting novelty to induce the consumer to purchase the food products. However, while packaging has made food products more convenient to the consumer, the majority are still simply a package which is discarded after opening. The food product must be prepared in a separate cooking device. This may be acceptable when traditional pots can be used for preparation, however when more exotic cooking devices are required the expense may be prohibitive.

Specific food products often require specialized packaging, to provide adequate protection to the food product. Specifically, this invention deals with tacos which traditionally are packaged in boxes which are semi-rigid to protect the integrity of the tacos. These boxes are generally discarded after opening, unless all the tacos are not used and are restored in the box. Tacos are a food which may be considered exotic when referring to the cooking devices used for preparation. While a taco may be prepared on a flat plate, its unique shape would require it to lay flat on one side. Because of its position, much of the filler material may fall out of the taco, and make preparation difficult. One side of the taco will get crisp, while the other side becomes soggy from oils running out onto the plate from the filler. This typically happens when a taco is heated in a microwave on a plate.

Specialized cooking utensils have been developed which will hold the taco in an upright position preventing filler from falling out. However, these devices are generally wire racks which cannot be used in microwave ovens. Also, the extra expense of a taco rack may make it unreasonable for someone who prepares tacos infrequently. One of the main purposes of packages for food products is to make the use of that food product more convenient for the consumer. While the current taco packages may make tacos more accessible to the consumer, they do not aid in preparation.

It will highly advantageous, therefore, to remedy the foregoing and other deficiencies inherent in the prior art.

Accordingly, it is an object of the present invention to provide improvements in packages for tacos.

Another object of the present invention is to provide a taco package which is convertible to a taco rack.

And another object of the present invention is to provide a convertible taco package which is microwave safe.

Still another object of the present invention is to provide a taco package which is relatively inexpensive.

Yet another object of the present invention is to provide a taco package which is convertible into a taco rack which elevates the tacos Yet still another object of the present invention is to provide a taco package which is convertible to a taco rack which may be used to store and cook tacos in an upright position.

SUMMARY OF THE INVENTION

Briefly, to achieve the desired objects of the instant invention in accordance with a preferred embodiment thereof, provided is a first portion, and a second portion receivable within said first portion. One of said first portion and second portion further includes a planar member having parallel perforations defining at least one strip extended there across. Each strip is bisected by a perforation extending across the medial portion thereof, perpendicular to each of the parallel perforations. Each strip can be separated from the planar member to form tabs. When the tabs are bent downwards, taco openings are formed corresponding to the strips. Tacos inserted in the taco holes will be supported by the tabs.

BRIEF DESCRIPTION OF THE DRAWINGS

The foregoing and further and more specific objects and advantages of the instant invention will become readily apparent to those skilled in the art from the following detailed description of the preferred embodiment thereof taken in conjunction with the drawings, in which.

DETAILED DESCRIPTION OF THE PREFERRED EMBODIMENT

Figures 1, 2, 3, 4, 5:
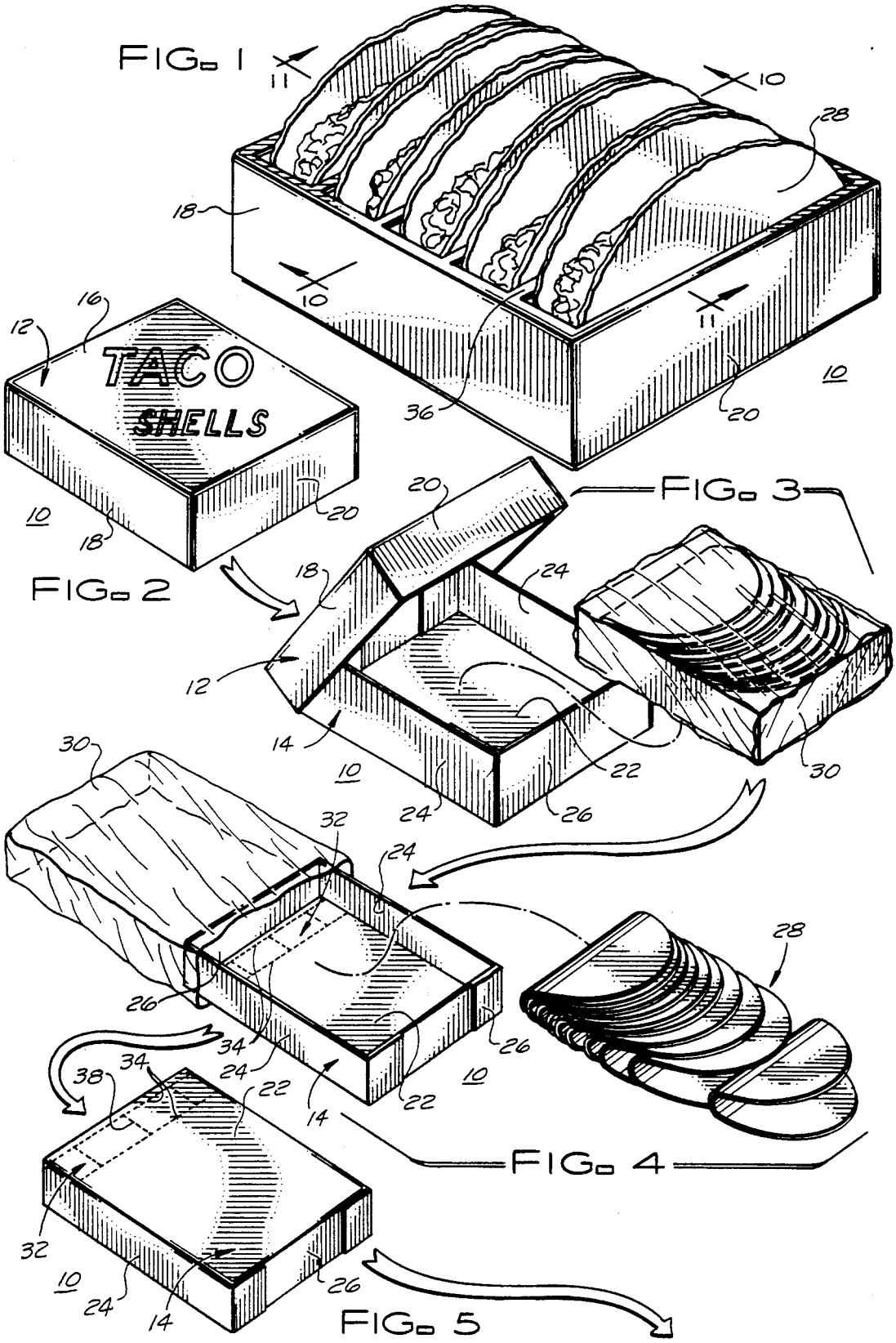
FIG. 1 is a perspective view of a convertible taco package, constructed in accordance with the teachings of the instant invention, as it would appear converted into a taco holder and holding tacos.
FIG. 2 is a perspective view of the convertible taco package as it would appear in a package configuration.
FIG. 3 is a perspective view of a convertible package as shown in FIG. 2 being opened with tacos removed.
FIG. 4 is a perspective view of the convertible taco package being re-used to store tacos after being used as a taco holder.
FIG. 5 illustrates the bottom portion of the convertible taco package illustrated in FIG. 4 being inverted in preparation for converting to a taco holder.

Turning now to the drawings in which like reference characters indicate corresponding elements throughout the several views, attention is first directed to FIGS. 1 and 2 which illustrate a convertible taco holder generally designated 10. Convertible taco holder 10 has two configurations, a package configuration as illustrated in FIG. 2 and a taco holder configuration as illustrated in FIG. 1. Each configuration will be discussed in greater detail below.

Referring now to FIGS. 2 and 3, convertible taco package 10 has a top portion 12 and a bottom portion 14 receivable therein. Top portion 12 consists of a substantially rectangular planner member 16, from which opposing sidewalls 18 and opposing endwalls 20 depend. Bottom portion 14 consists of a substantially rectangular planar member 22 from which opposing sidewalls 24 and opposing endwalls 26 depend.

Bottom portion 14 is receivable in top portion 12 to form a semi-rigid container capable of protecting the integrity of taco shells 28. Top portion 12 and bottom portion 14 may be formed from any bendable sheet material, however in the preferred embodiment, recyclable paper products are preferred. A number of taco shells 28 are stacked together and inserted into a bag 30 which can be sealed to keep taco shells 28 crisp and fresh. Taco shells 28 in bag 30 are then inserted into the bottom portion 14 of convertible taco package 10, which is then receivable in top portion 12. By using convertible taco package 10, taco shells 28 will remain fresh in bag 30 and retain their integrity by the semi-rigid nature of top portion 12 and bottom portion 14.

Figure 8:
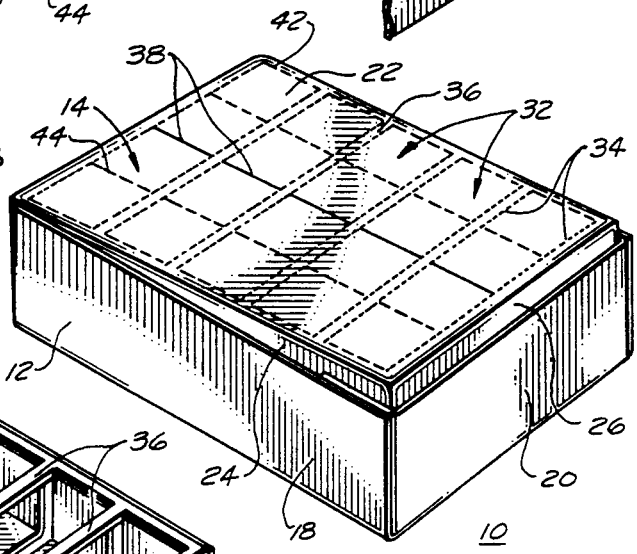
FIG. 8 is a perspective view of an inverted convertible taco package illustrated in FIG. 2.

With additional reference to FIG. 8, planar member 22 of bottom portion 14 is divided into parallel spaced apart strips 32 extending between sidewalls 24. Each strip 32 is defined by a pair of parallel perforations 34 extending linearly between sidewalls 24 along the width of bottom 14. Parallel perforations 34 are separated by the approximate width of a taco shell 28, and each pair of parallel perforations 34 is separated by a bar 36 of planar member 22. A medial perforation 38 extends perpendicularly across the medial portion of each strip 32, between parallel perforations 34.

Figure 7:
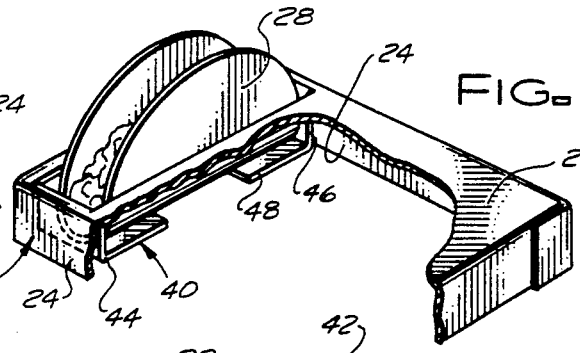
FIG. 7 is a partial perspective view of the convertible taco package illustrated in FIG. 5 & 6 converted into a taco holder and holding a taco.

Still referring to FIG. 7, taco shell 28 is inserted into slot 50 between depending sections 46 of tabs 40. Support section 48 of tabs 40 extend substantially parallel to planar member 22, supporting taco shell 28.

Referring now to FIG. 4, once convertible taco package 10 has been opened, taco shells 28 may be repackaged, by inserting stack taco shells 28 into bottom portion 14, then inserting bottom portion 14 into bag 30. Even if bottom portion 14 had a slot 50 formed in it, converting it into a taco holder, tabs 40 can be pushed partially back into slot 50. Unused tacos 28 can then be restored in bottom portion 14. Repackaging in this manner allows bottom portion 14 to protect the integrity of taco shells 28, while bag 30 insures their freshness.

Figure 6:
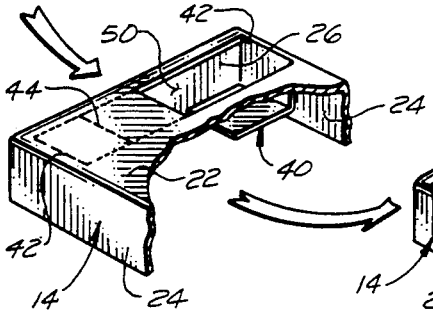
FIG. 6 is a partial perspective view of the convertible taco package bottom illustrated in FIG. 5 being converted to a taco holder.

Referring now to FIGS. 5–7, convertible taco package 10 is illustrated being converted into a taco holder. For purposes of illustration, a single strip 32 defined by parallel perforations 34 is illustrated, but those skilled in the art will understand that more strips may be defined as illustrated in FIG. 8. Referring specifically to FIG. 5, bottom portion 14 is inverted to expose strip 32. Strip 32 is separated from planar member 22 along parallel perforations 34. Strip 32 is separated into tabs 40 at medial perforation 38. Tabs 40 remain hingedly coupled to bottom portion 14 at sidewalls 24, illustrated by dotted lines 42. Tabs 40 have a medial bend 44 illustrated by a broken line, which gives them a generally L-shaped profile when in the taco holder configuration. A depending section 46 extends from hinge 42 to bend 44 and a support section 48 extends from bend 44. As can be seen in FIG. 7, the disengagement of strip 32 from planar surface 22, at parallel perforations 34, and medial perforation 38, produces tabs 40. When tabs 40 are bent downward at hinge 42, so that depending section 46 is substantially parallel to sidewalls 24, a slot 50 is formed in planner surface 22. Slot 50 extends between side walls 24 having a length and width sufficient to accommodate a taco shell 28.

Figure 9:
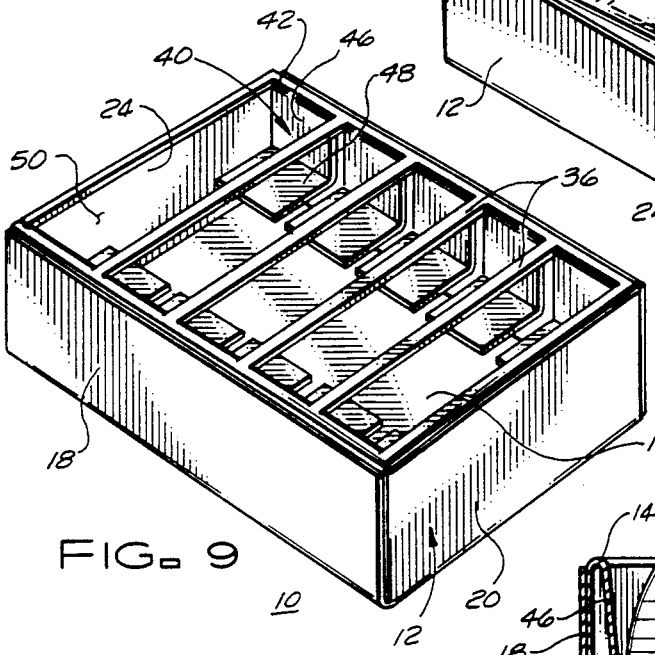
FIG. 9 is a perspective view of the convertible taco package illustrated in FIG. 8, converted into a taco holder.

While bottom portion 14 is illustrated converted into a taco holder with a single slot 50, it will be understood that more than one slot 50 may be formed as illustrated in FIG. 9. FIG. 9 illustrates five slots 50 formed in the same manner as that in discussed in FIG. 5–7. FIG. 9 illustrates convertible taco package 10 inverted so that bottom portion 14 is accessible. Strips 32 are detached from planar member 22 at parallel perforations 34 and medial perforations 38. Tabs 40 of strips 32 are then bent downward towards top proportion 12, forming slot 50 separated by bars 36. Support sections 48 of tabs 40 extend inwardly away from side walls 24, substantially parallel to planar member 22 of bottom portion 14 and planar member 16 of top portion 12.

Figure 10:
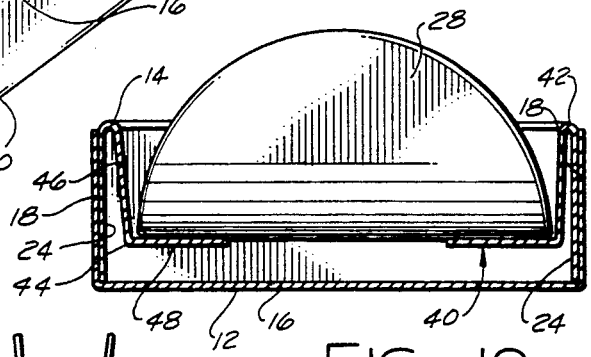
FIG. 10. is a cross-sectional end view taken along line 10—10 of FIG. 1.

Referring now to FIG. 10, a taco shell 28 is inserted into slot 50, and supported above planar member 16 of top portion 12 by support sections 48 of tabs 40. In this instance, top portion 12 functions as a drip pan catching any fluids dropping from taco shells 28. Because taco shells 28 are suspended above planar member 16 of top portion 12, there is no contact between taco shells 28 and the fluids caught by top portion 12. This results in a taco shell which remains crisp and does not become soggy from contact with the fluids.

Figure 11:
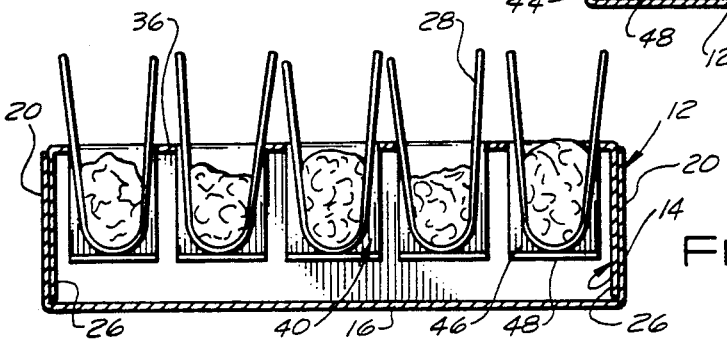
FIG. 11 is a cross-sectional side view taken along line 11—11 of FIG. 1.

FIG. 11, illustrates convertible taco package 10 with 5 slots 50, containing tacos in an upright position. This prevents the loss of any filler material, while keeping the tacos suspended above any lost fluid.

Those skilled in the art will understand that while top portion 12 is employed as a drip pan in FIG. 9–11, bottom portion 14 may be employed alone. Also, while FIGS. 6 and 7 illustrate bottom portion 14 being used alone, it will be understood that top portion 12 could be used as a drip pan. Those skilled in the art will also understand that while slots 50 were formed in bottom portion 14 for purposes of illustration, they could be formed in top portion 12 while bottom portion 14 acts as a drip pan.

Various changes in modifications to the embodiment herein chosen for purpose of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A convertible taco package comprising:

a first portion;

a second portion receivable within said first portion having;

a planar member, parallel perforations in a said planar member defining at least one strip, a medial perforation extending across a medial portion of said at least one strip perpendicular to said parallel perforations and dividing said at least one strip into two tabs, a slot extending through said planar member, corresponding to said at least one strip when said strip is disengaged from said planar member at said parallel perforations and said medial perforations.

2. A convertible taco package as claimed in claim 1 wherein said second portion further comprises substantially parallel sidewalls and substantially parallel endwalls extending from and perpendicular to said planar member.

3. A convertible taco package as claimed in claim 2 wherein said tabs are each hingedly coupled to opposing sidewalls.

4. A convertible taco package for holding at least a taco shell comprising:

a first portion;

a second portion receivable within said first portion having;

a planar member, parallel perforations in said planar member defining at least one strip, said at least one strip constructed to separate from said planar member at said parallel perforations, and to divide into two tabs at a medial perforation extending across a portion of said at least one strip perpendicular to said parallel perforations, said tabs hingedly depending from said planar member, and constructed to be bent in a substantially L-shaped profile when separated from said planar member at said parallel perforations and at said medial perforations, at least one slot configured to receive said taco shell, through said planar member, corresponding to said at least one strip when said strip is disengaged from said planar member at said parallel perforations and said medial perforations.

5. A convertible taco package as claimed in claim 4 wherein said second portion further comprises substantially parallel sidewalls and substantially parallel endwalls extending from and perpendicular to said planar member.

6. A convertible taco package as claimed in claim 5 wherein said tabs are each hingedly coupled to said planar member, proximate said sidewalls.

7. A method of converting a convertible taco package into a taco holder comprising:

providing a convertible taco package having;

a first portion, a second portion receivable within said first portion and having, a planar member, parallel perforations in said planar member defining at least one strip, a medial perforation extending across a medial portion of said at least one strip perpendicular to said parallel perforations and dividing said at least one strip into two tabs, at least one slot configured to receive a taco shell extending through said planar member, corresponding to said at least one strip when said strip is disengaged from said planar member at said parallel perforations and said medial perforations, disengaging said at least one strip from said planar member at said parallel perforations;

separating said strip into tabs at said medial perforations; and bending said tabs into a substantially L-shaped profile depending perpendicularly from said planar member to form a support for a taco shell received by said at least one slot.

* * * * *